US009105968B2

(12) United States Patent
Hong et al.

(10) Patent No.: US 9,105,968 B2
(45) Date of Patent: Aug. 11, 2015

(54) ANTENNA ASSEMBLY AND MOBILE TERMINAL USING SAME

(71) Applicants: Ng Guan Hong, Shenzhen (CN); Tay Yew Siow, Shenzhen (CN)

(72) Inventors: Ng Guan Hong, Shenzhen (CN); Tay Yew Siow, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 14/198,990

(22) Filed: Mar. 6, 2014

(65) Prior Publication Data

US 2014/0306848 A1 Oct. 16, 2014

(30) Foreign Application Priority Data

Mar. 22, 2013 (CN) ..... 2013 1 0094784

(51) Int. Cl.

| | |
|---|---|
| ***H01Q 1/24*** | (2006.01) |
| ***H01Q 1/48*** | (2006.01) |
| ***H01Q 9/42*** | (2006.01) |
| ***H01Q 5/378*** | (2015.01) |

(52) U.S. Cl.

CPC ..... *H01Q 1/243* (2013.01); *H01Q 1/48* (2013.01); *H01Q 5/378* (2015.01); *H01Q 9/42* (2013.01)

(58) Field of Classification Search

USPC ..... 343/702

See application file for complete search history.

(56) References Cited

U.S. PATENT DOCUMENTS

2012/0206302 A1* 8/2012 Ramachandran et al. .... 343/702
2012/0262345 A1* 10/2012 Kim et al. ..... 343/702

* cited by examiner

*Primary Examiner* — Graham Smith

(74) *Attorney, Agent, or Firm* — IPro, Inc.; Na Xu

(57) ABSTRACT

An antenna assembly of the present disclosure includes a grounding plate, a metal plate, a metal frame and an antenna body disposed between the grounding plate and the metal plate. The metal frame includes a closed annular portion, and the antenna body includes a feeding portion. One end of the feeding portion is electrically connected to the metal plate and the other end thereof is spaced apart from the grounding plate, and the closed annular portion is spaced apart from the metal plate. The antenna assembly of the present disclosure can improve the performances of the product and make the appearance of the product more aesthetic. Meanwhile, the present disclosure also provides a mobile terminal using the antenna assembly described above.

12 Claims, 6 Drawing Sheets

ANTENNA ASSEMBLY AND MOBILE TERMINAL USING SAME

FIELD OF THE INVENTION

The present disclosure relates to an antenna assembly and a mobile terminal using same.

DESCRIPTION OF RELATED ART

With development of the communication technologies, wireless mobile devices, especially, mobile phones, are used more and more widely. Nowadays, the mobile phones are not only required to have the simple calling function, but also required to have a miniaturized size and a good communication quality. Correspondingly, as an important component in the communication devices, the development of the antenna assembly is received more and more attention.

A conventional antenna assembly of a mobile phone is embedded in the mobile phone, and typically comprises an antenna body and a metal frame. The metal frame comprises a first portion, a second portion and a gap. The first portion cooperates with the second portion to form a loop structure around the mobile phone, and the first portion and the second portion are arranged at intervals via the gap, thereby a radiating body of the antenna is obtained by the first portion. However, the gap of this structure metal frame is not only became a sensitive portion of the antenna assembly, but also adversely affects the aesthetic structure of the product.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE INVENTION

Hereinbelow, the present disclosure will be further described with reference to the attached drawings and embodiments thereof.

Figure 1:
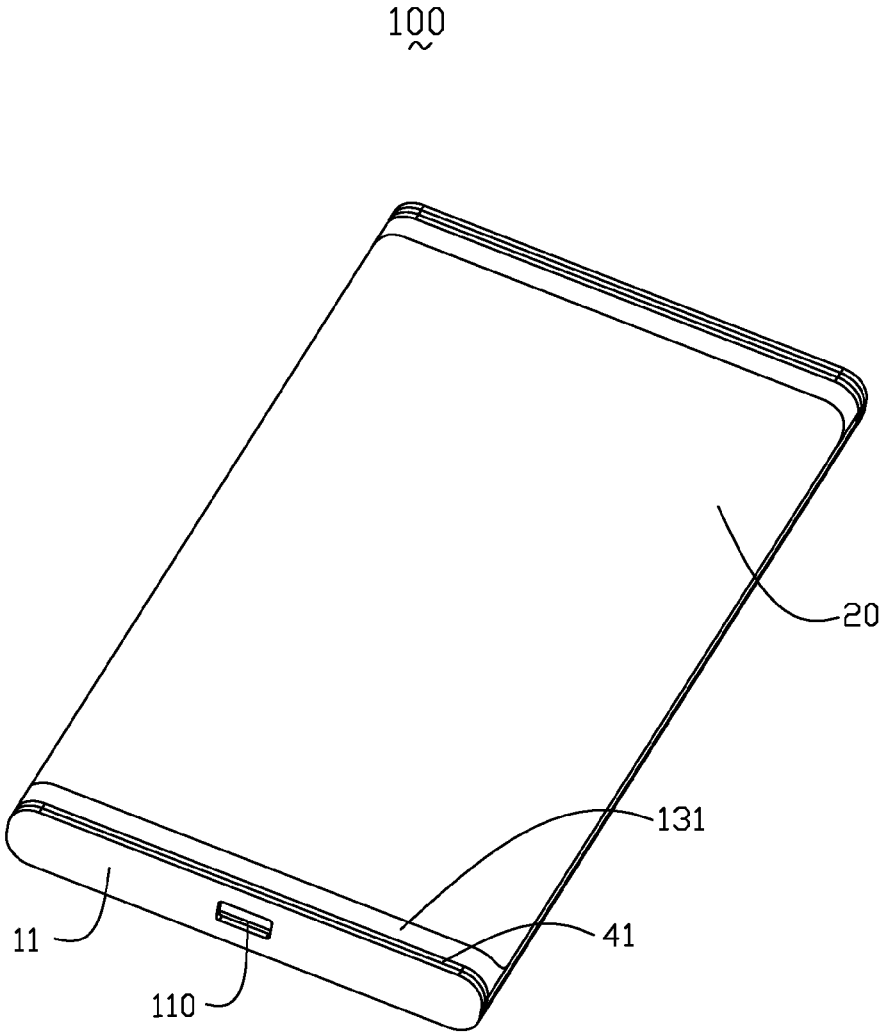
FIG. 1 is an isomeric view of a mobile terminal according to an exemplary embodiment of the present disclosure.
Figure 2:
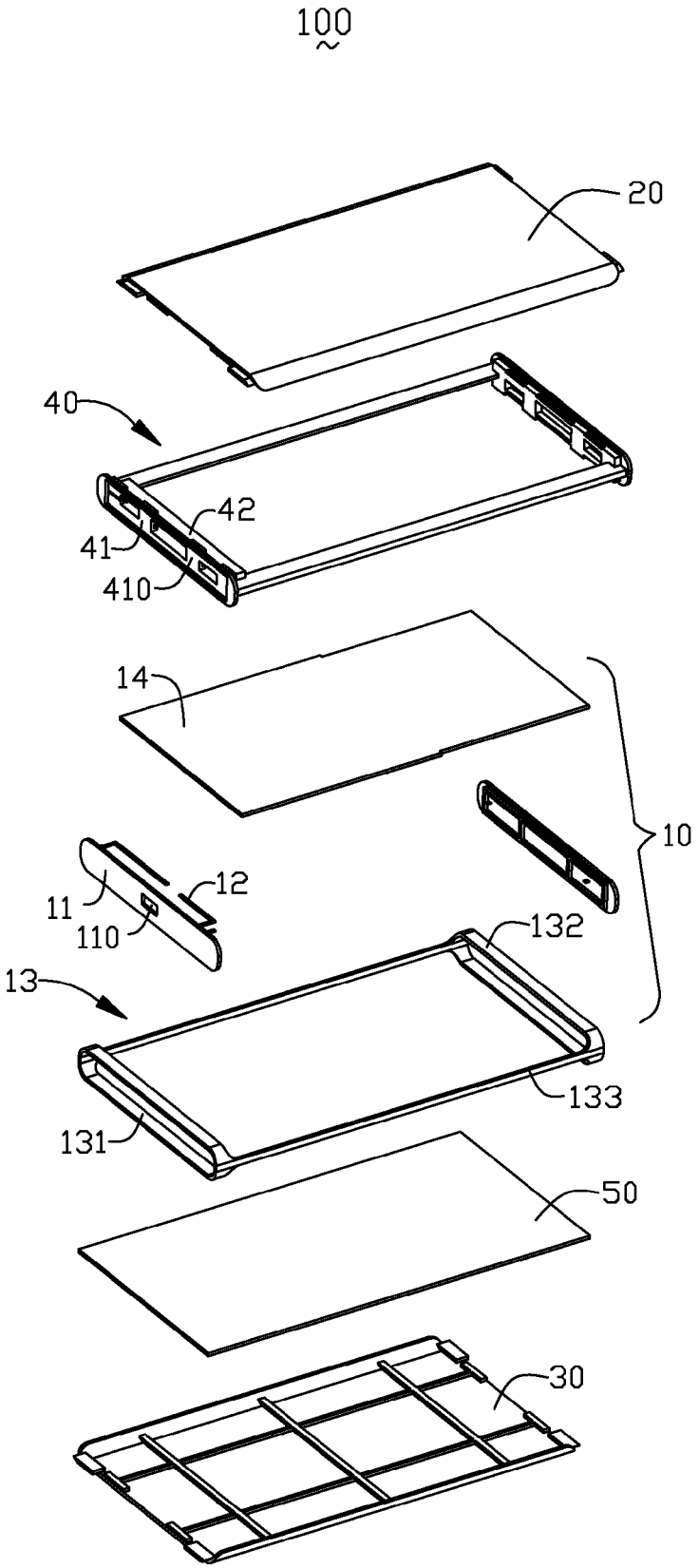
FIG. 2 is an exploded, isometric view of the mobile terminal shown in FIG. 1.
Figure 3:
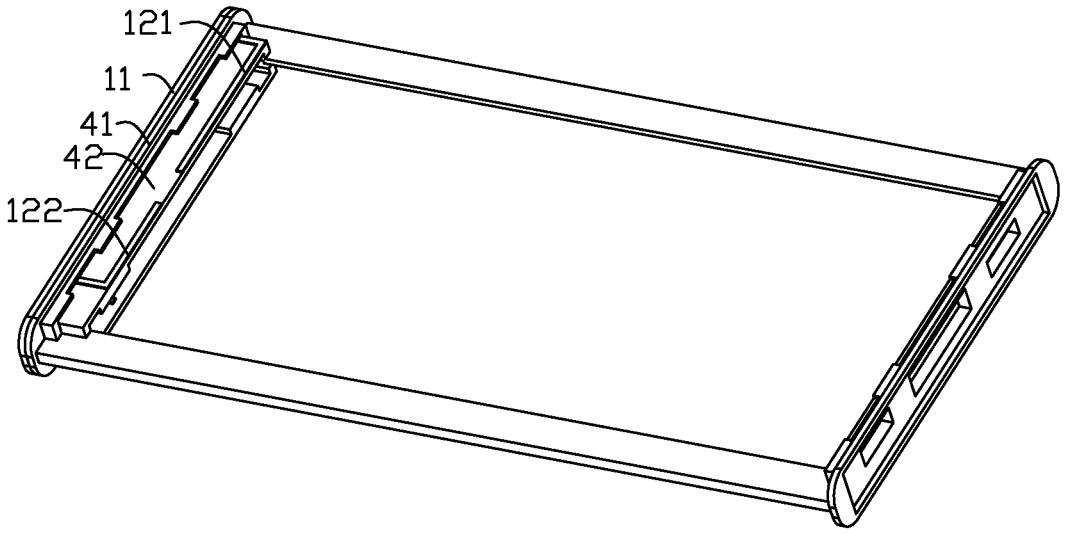
FIG. 3 is a part assembly view of the mobile terminal shown in FIG. 2.
Figure 4:
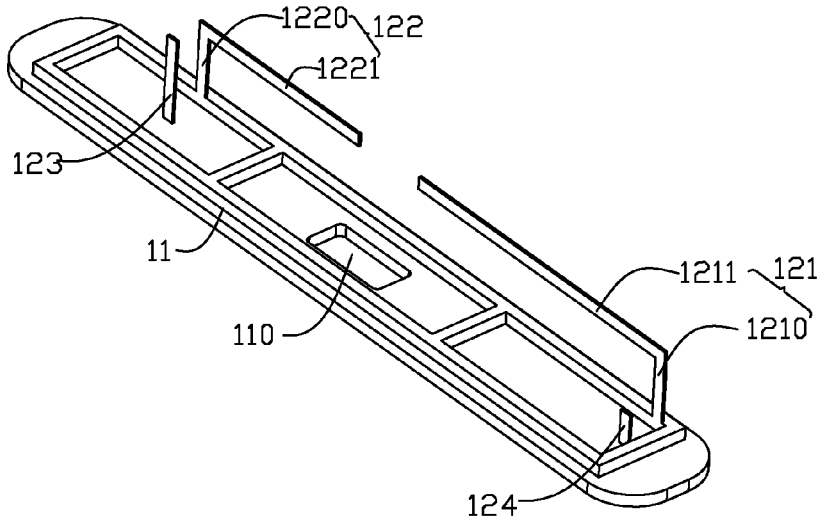
FIG. 4 is an assembly view of a metal plate and an antenna body of the antenna assembly shown in FIG. 2.

Referring to FIG. 1 and FIG. 2, a mobile terminal 100 according to an embodiment of the present invention is shown. It is well known, the mobile terminal 100 can be mobile phones, tablet computers, or multimedia players. In the preferred embodiment, the mobile terminal 100 is a smart mobile phone.

The mobile terminal 100 comprises a top cover 20, a bottom cover 30, a shell 40, a ferrite plate 50 and an antenna assembly 10. The top cover 20 and the bottom cover 30 are respectively positioned onto the top and bottom ends of the shell 40, thereby form a receiving space for receiving the ferrite plate 50 and the antenna assembly 10 therein.

The antenna assembly 10 comprises a metal plate 11, an antenna body 12, a metal frame 13 and a grounding plate 14. The metal plate 11 is spaced apart from the grounding plate 14. The antenna body 12 is sandwiched between a side surface of the grounding plate 14 and the metal plate 11 integrated with the metal plate 11. The metal frame 13 is engaged with the shell 40, and the grounding plate 14 is positioned between the shell 40 and the metal frame 13. The ferrite plate 50 is attached on the bottom surface of the grounding plate 14 and received in a middle region of the shell 40. In the top-to-bottom direction, the grounding plate 14 is disposed adjacent to the top cover 20 and the ferrite plate 50 is disposed adjacent to the bottom cover 30.

Referring to FIGS. 3-6, the antenna body 12 comprises a first branch 121, a second branch 122 symmetrically arranged opposite to the first branch 121, a feeding portion 123 and a third branch 124. The feeding portion 123 is spaced to the second branch 122 and the third branch 124 is spaced to the first branch 121. In the preferred embodiment, the first and second branches 121, 122 are L-shaped configuration and are coplanar to each other. The feeding portion 123 and the third branch 124 are strike-like sheet configuration. The first branch 121 and the second branch 122 both extend from a side of the metal plate 11, while the feeding portion 123 and the third branch 124 both perpendicularly extend upward from a middle portion of the metal plate 11. The feeding portion 123 is positioned adjacent to the first branch 121, and the third branch 124 is positioned adjacent to the second branch 122.

The shell 40 comprises two sidewalls 41 and a supporting stage 42. The two sidewalls 41 are located at two opposite sides thereof and spaced apart from each other. The supporting stage 42 extends from an inner surface of the sidewall 41 toward the grounding plate 14. The first branch 121 and the second branch 122 are disposed on the supporting stage 42.

The first branch 121 comprises a first arm 1210 perpendicularly extending upward from the metal plate 11, and a first extension portion 1211 horizontally extending toward the second branch 122 from an end of the first arm 1210 away from the metal plate 11.

The second branch 122 also comprises a second arm 1220 perpendicularly extending upward from the metal plate 11, and a second extension portion 1221 horizontally extending toward the first branch 121 from an end of the second arm 1220 away from the metal plate 11. The first extension portion 1211 and the second extension portion 1221 are arranged in line with each other, thereby a gap formed therebetween. An orthographic projection of the first extension portion 1211 on the metal plate 11 does not overlap with that of the second extension portion 1221 on the metal plate 11.

Additionally, one end of the third branch 124 is connected to the metal plate 11 and the other end thereof is spaced apart from the grounding plate 14 to form a gap therebetween.

Figure 5:
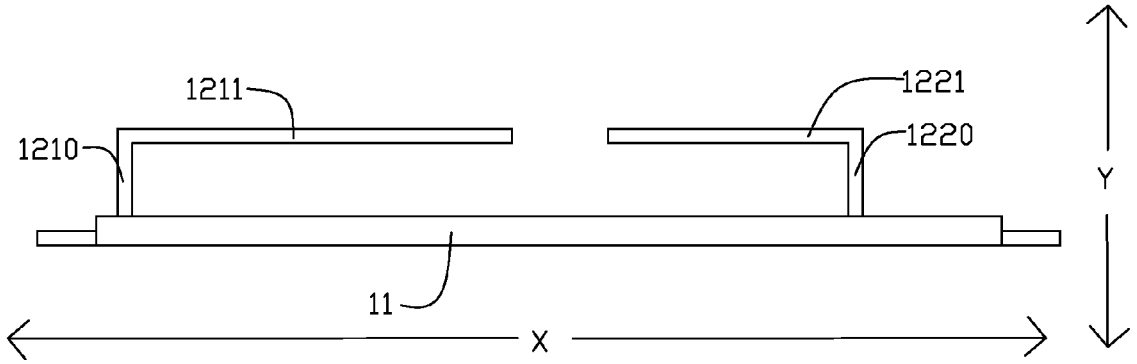
FIG. 5 is a back view of the metal plate and the antenna body of the antenna assembly shown in FIG. 4.
Figure 6:
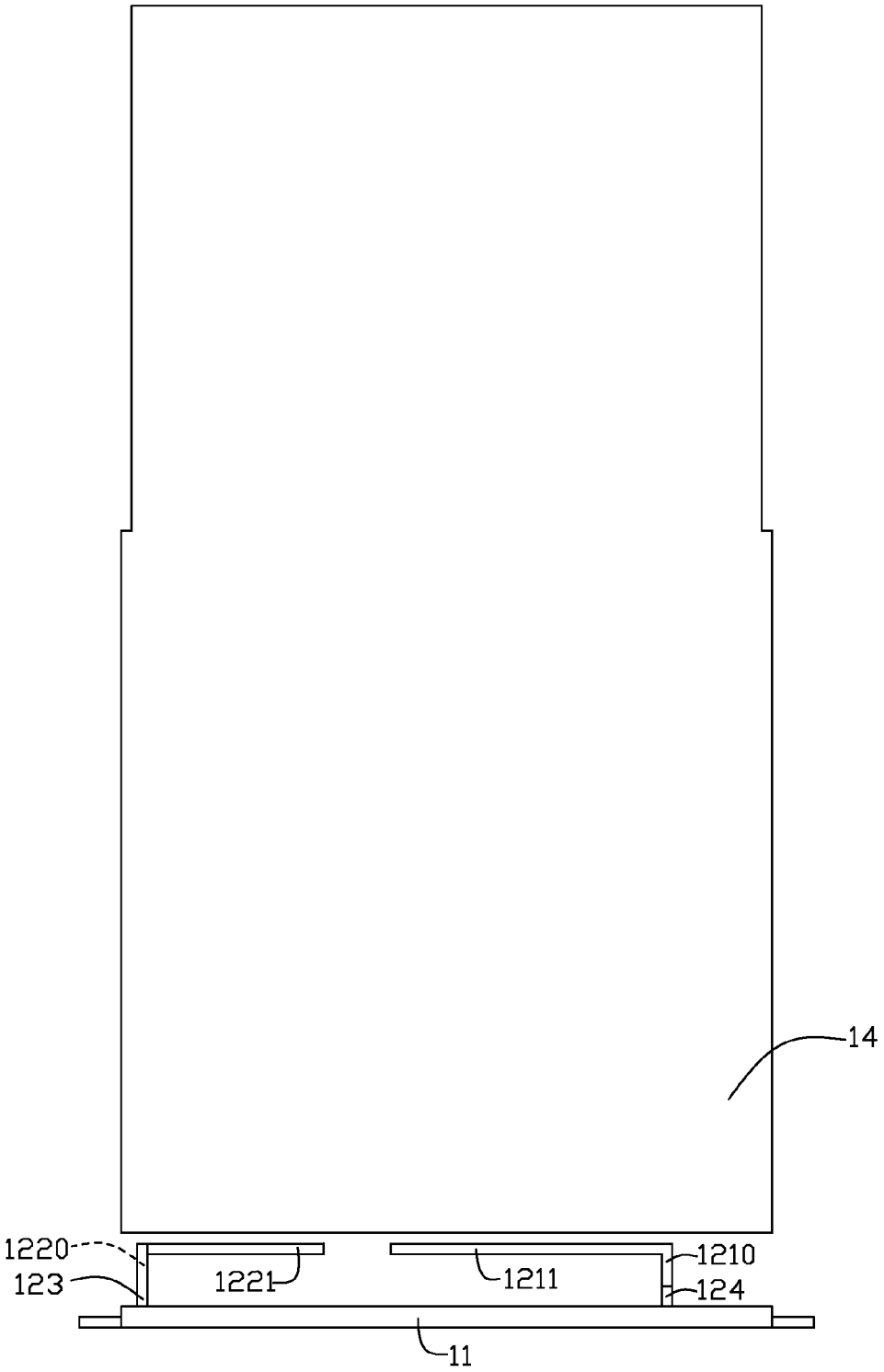
FIG. 6 is a front view of the metal plate, the antenna body of the antenna assembly shown in FIG. 5.

Referring to FIG. 5, the height direction of the metal plate 11 is defined as a longitudinal direction Y, and the length direction of the metal plate 11 is defined as a lateral direction X. Then, all of the first arm 1210, the second arm 1220, the third branch 124 and the feeding portion 123 extend along the longitudinal direction Y. The first extension portion 1211 and the second extension portion 1221 parallelly extend along the lateral direction X. An orthographic projection of the first arm 1210 on the grounding plate 14 is partially overlapped with that of the third branch 124, while an orthographic projection of the second arm 1220 on the grounding plate 14 is partially overlapped with that of the feeding portion 123. During testing, parameters of the antenna assembly 10 can be adjusted by adjusting the distance between the third branch 124 and the grounding plate 14 or by adjusting the distance between the first extension portion 1211 and the second extension portion 1221 so that the operation frequency band of the antenna assembly 10 can be adjusted to achieve good optimal performances of the antenna assembly 10.

Referring back to FIG. 2, the metal frame 13 comprises a first closed annular portion 131 and a second closed annular portion 132 located at two opposite sides of the top cover 20 and a pair of connecting rods 133 respectively connecting to two opposite ends of the first closed annual portion 131 and the second loop portion 132. The sidewall 41 of the shell 40 is disposed between the metal plate 11 and the first annular portion 131, thereby forming a gap therebetween. Specifically, the metal plate 11 is attached on an outer surface 410 of the sidewall 41. The first annular portion 131 connects with the periphery of an inner surface of the sidewall 41. A gap is formed between one end of the feeding portion 123 and the grounding plate 14, and the other end of the feeding portion 123 is electrically connected to the metal plate 11.

When the antenna assembly 10 is on work, the metal plate 11 is defined as a radiation element and the first annular portion 131 is defined as a parasitic unit. A signal is input into the feeding portion 123 and radiated by the metal plate 11, and then coupled to the first closed annual portion 131 so as to increase the radiation area of the antenna assembly 10 and improve the product performances.

Furthermore, because the first annular portion 131 of the metal frame 13 is a closed loop structure, the gap in the metal frame 13 is no longer as a sensitive portion of the antenna assembly 10. Both the metal frame 13 and the metal plate 11 are exposed out of the mobile terminal 100, the appearance of the whole product is more aesthetic and the overall structure of the mobile terminal 100 becomes more firm.

In the preferred embodiment, the mobile terminal 100 may further comprise an USB module (not shown) and a speaker module (not shown). The USB module and the speaker module are disposed between the sidewall 41 of the shell 40 and the grounding plate 14, and the metal plate 11 defines a through hole 110 connected to the front end of the USB module so that the USB module can more conveniently connect with an external circuit.

Figure 7:
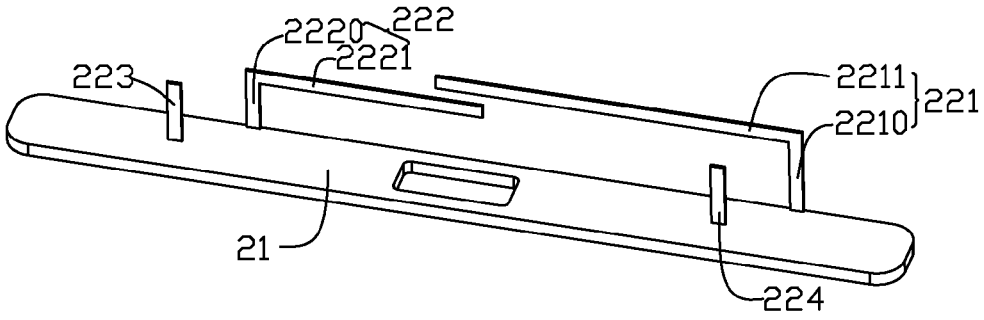
FIG. 7 is an isometric view of a metal plate and an antenna body of a mobile terminal according to another embodiment of the present disclosure.
Figure 8:
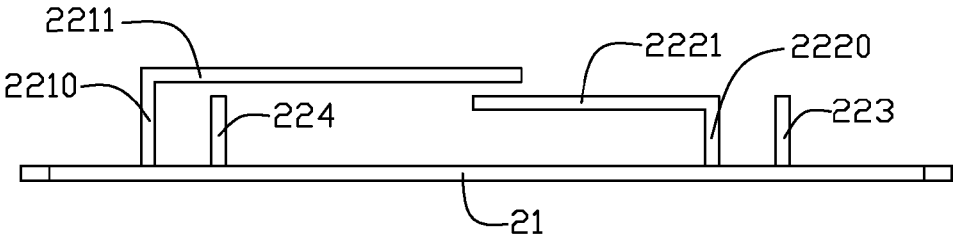
FIG. 8 is a back view of the metal plate and the antenna body of the antenna assembly shown in FIG. 7.

Referring to FIG. 7 and FIG. 8, FIG. 7 is a schematic perspective structural view of a metal plate and an antenna body of a mobile terminal according to a second exemplary embodiment of the present disclosure. in this embodiment, the difference of the mobile terminal from that of the first embodiment is shown that: the first branch 221 comprises a first arm 2210 and a first extension portion 2211. The second branch 222 comprises a second arm 2220 and a second extension portion 2221. The first extension portion 2211 and the second extension portion 2221 are staggered on two different parallel lines. Furthermore, an orthographic projection of the first extension portion 2211 on the metal plate 21 partially overlaps that of the second extension portion 2221 on the metal plate 21, an orthographic projection of the first arm 2210 on the grounding plate does not overlap that of the third arm 224 on the grounding plate, and an orthographic projection of the second arm 2220 on the grounding plate does not overlap that of the feeding portion 223 on the grounding plate.

In other embodiments, the configuration and the shape of the antenna can be differently selected according to different needs and different operation frequency bands.

What described above are only preferred embodiments of the present disclosure, and the scope of the present disclosure is not limited to what described above. Rather, any equivalent modifications or changes made by those of ordinary skill in the art according to the contents of the present disclosure shall all fall within the scope of the present disclosure.

What is claimed is:

1. An antenna assembly, comprising:

a grounding plate, a metal plate spaced apart from the grounding plate, a metal frame, and an antenna body disposed between the grounding plate and the metal plate, and wherein the metal frame comprises a closed annular portion, and the antenna body comprises a first branch, a second branch symmetrically arranged opposite to the first branch, a feeding portion, the first branch and the second branch coplanar each other, the first branch comprises a first arm perpendicularly extending upward from the metal plate and a first extension portion horizontally extending toward the second branch from an end of the first arm away from the metal plate, and the second branch comprises a second arm perpendicularly extending upward from the metal plate and a second extension portion horizontally extending toward the first branch from an end of the second arm away from the metal plate, the first extension portion and the second extension portion are arranged in line with each other so that a gap is formed therebetween, an orthographic projection of the first extension portion on the metal plate does not overlap that of the second extension portion on the metal plate; one end of the feeding portion electrically connected to the metal plate and the other end thereof spaced apart from the grounding plate, the annular portion spaced apart from the metal plate.

2. The antenna assembly of claim 1, wherein the antenna body further comprises a strip-like third branch connected to the metal plate and located between the metal plate and the grounding plate, and a gap is formed between the third branch and the grounding plate.

3. A mobile terminal, comprising:

an USB module, a speaker module, a shell, and an antenna assembly, the antenna assembly comprising:

a grounding plate, a metal plate spaced apart from the grounding plate, a metal frame, an antenna body disposed between the grounding plate and the metal plate, and wherein the metal frame comprises a closed annular portion, and the antenna body comprises a first branch, a second branch symmetrically arranged opposite to the first branch, a feeding portion, the first branch and the second branch coplanar each other, the first branch comprises a first arm perpendicularly extending upward from the metal plate and a first extension portion horizontally extending toward the second branch from an end of the first arm away from the metal plate, and the second branch comprises a second arm perpendicularly extending upward from the metal plate and a second extension portion horizontally extending toward the first branch from an end of the second arm away from the metal plate, the first extension portion and the second extension portion are arranged in line with each other so that a gap is formed therebetween, an orthographic projection of the first extension portion on the metal plate does not overlap that of the second extension portion on the metal plate; one end of the feeding portion electrically connected to the metal plate and the other end thereof spaced apart from the grounding plate, the annular portion spaced apart from the metal plate.

4. The mobile terminal of claim 3, wherein the first annular portion is located at one side of the mobile terminal, and the metal frame further comprises a second closed annular portion located at the other side of the mobile terminal and a pair of connecting rods connected to the first annular portion and the second annular portion.

5. The mobile terminal of claim 3, wherein the shell has two sidewalls located between the metal plate and the first annular portion, the metal plate is attached on the outer surface of the sidewall, and the first annular portion connects with the inner surface of the sidewall.

6. The mobile terminal of claim 5, wherein the shell comprises a supporting stage extending from the inner surface towards the grounding plate, and the first branch and the second branch are disposed on the supporting stage.

7. An antenna assembly, comprising:

a grounding plate, a metal plate spaced apart from the grounding plate, a metal frame, and an antenna body disposed between the grounding plate and the metal plate, and wherein the metal frame comprises a closed annular portion, and the antenna body comprises a first branch, a second branch symmetrically arranged opposite to the first branch, a feeding portion, the first branch and the second branch coplanar each other, the first branch comprises a first arm perpendicularly extending upward from the metal plate and a first extension portion horizontally extending toward the second branch from an end of the first arm away from the metal plate, and the second branch comprises a second arm perpendicularly extending upward from the metal plate and a second extension portion horizontally extending toward the first branch from an end of the second arm away from the metal plate, the first extension portion and the second extension portion are arranged in line with each other so that a gap is formed therebetween, an orthographic projection of the first extension portion on the metal plate partially overlaps that of the second extension portion on the metal plate; one end of the feeding portion electrically connected to the metal plate and the other end thereof spaced apart from the grounding plate, the annular portion spaced apart from the metal plate.

8. The antenna assembly of claim 7, wherein the antenna body further comprises a strip-like third branch connected to the metal plate and located between the metal plate and the grounding plate, and a gap is formed between the third branch and the grounding plate.

9. A mobile terminal, comprising:

an USB module, a speaker module, a shell, and an antenna assembly, the antenna assembly comprising:

a grounding plate, a metal plate spaced apart from the grounding plate, a metal frame, an antenna body disposed between the grounding plate and the metal plate, and wherein the metal frame comprises a closed annular portion, and the antenna body comprises a first branch, a second branch symmetrically arranged opposite to the first branch, a feeding portion, the first branch and the second branch coplanar each other, the first branch comprises a first arm perpendicularly extending upward from the metal plate and a first extension portion horizontally extending toward the second branch from an end of the first arm away from the metal plate, and the second branch comprises a second arm perpendicularly extending upward from the metal plate and a second extension portion horizontally extending toward the first branch from an end of the second arm away from the metal plate, the first extension portion and the second extension portion are arranged in line with each other so that a gap is formed therebetween, an orthographic projection of the first extension portion on the metal plate partially overlaps that of the second extension portion on the metal plate; one end of the feeding portion electrically connected to the metal plate and the other end thereof spaced apart from the grounding plate, the annular portion spaced apart from the metal plate.

10. The mobile terminal of claim 9, wherein the first annular portion is located at one side of the mobile terminal, and the metal frame further comprises a second closed annular portion located at the other side of the mobile terminal and a pair of connecting rods connected to the first annular portion and the second annular portion.

11. The mobile terminal of claim 9, wherein the shell has two sidewalls located between the metal plate and the first annular portion, the metal plate is attached on the outer surface of the sidewall, and the first annular portion connects with the inner surface of the sidewall.

12. The mobile terminal of claim 11, wherein the shell comprises a supporting stage extending from the inner surface towards the grounding plate, and the first branch and the second branch are disposed on the supporting stage.

* * * * *